US005373699A

United States Patent [19]

Gastinne et al.

[11] Patent Number: 5,373,699

[45] Date of Patent: Dec. 20, 1994

[54] PROCESS FOR THE PRODUCTION OF NITROGEN BY CRYOGENIC DISTILLATION OF ATMOSPHERIC AIR

[75] Inventors: Sophie Gastinne, Notre Dame de Gravencho; Francois Venet, Paris, both of France; Bao Ha, Vacaville, Calif.; Naohiko Yamashita, Kobe, Japan

[73] Assignees: L'Air Liquide, Societe Anonyme Pour L'Etude et L'Exploitation des Procedes George Claude, Paris Cedex, France; Liquid Air Engineering Corporation, Montreal, Canada; Teisan, K.K., Tokyo, Japan

[21] Appl. No.: 133,292

[22] Filed: Oct. 8, 1993

Related U.S. Application Data

[63] Continuation of Ser. No. 843,940, Feb. 18, 1992, Pat. No. 5,325,674, which is a continuation-in-part of Ser. No. 568,720, Aug. 17, 1990, abandoned.

[30] Foreign Application Priority Data

Aug. 18, 1989 [FR] France ..... 89 11009

[51] Int. Cl.[5] ..... F25J 3/02

[52] U.S. Cl. ..... 62/24; 62/38; 62/40

[58] Field of Search ..... 62/13, 24, 38, 40

[56] References Cited

U.S. PATENT DOCUMENTS

| | | | |
|---|---|---|---|
| 4,303,428 | 12/1981 | Vandenbussche | 62/13 |
| 4,662,916 | 5/1987 | Agrawal et al. | 62/13 |
| 4,662,917 | 5/1987 | Cormier et al. | 62/13 |
| 4,853,015 | 8/1989 | Yoshino | 62/40 |
| 4,947,649 | 8/1990 | Agrawal et al. | 62/24 |

*Primary Examiner*—Ronald C. Capossela
*Attorney, Agent, or Firm*—Oblon, Spivak, McClelland, Maier, & Neustadt

[57] ABSTRACT

An air separation process wherein a nitrogen enriched fraction is withdrawn from the distillation column, a portion of which is compressed and recycled through the lowest positioned reboiler in the column and directed to an upper portion of the column as reflux.

23 Claims, 7 Drawing Sheets

1
2
2a
3
4
4a
4b
5
6
7
8
9
10
11
12
13
14
15
16
17
20
70
X
Y

Y
X
1
2
2a
3
4
4a
4b
4c
5
6
7
8
9
10
11
12
13
14
15
16
17
20
111
112

10
15
9
11
16
17
8
11
20
7
4
5
4a
4b
4c
6
12
112
1
50
3
14
111
11
51
1b
2a
2
Y
14
1
1a
13
X
11
9
9

9
8
169
11
7
177
400
4
167
168
5
4a
4b
4c
6
155
166
112
1
18
3
2a
111
14
2
Y
X
13
9

9
8
17
11
10
20
7
4
5
4a
4b
4c
6
12
112
11
142
141
144
41
143
2
2b
Y
13
14
1
X
11
9
9

PROCESS FOR THE PRODUCTION OF NITROGEN BY CRYOGENIC DISTILLATION OF ATMOSPHERIC AIR

This is a continuation of application Ser. No. 07/843,940, filed on Feb. 18, 1992, now U.S. Pat. No. 5,325,674, which is a continuation-in-part (CIP) of application Ser. No. 07/568,720, filed on Aug. 17, 1990, now abandoned.

BACKGROUND OF THE INVENTION

Technical Field

The present invention relates to a process for producing nitrogen by cryogenic distillation of atmospheric air.

Several processes are known in the art for the production of nitrogen by cryogenic distillation of atmospheric air. Past process schemes can be classified into three major categories based on the method used to provide the required refrigeration for the process: oxygen-rich gas expansion, air expansion and nitrogen-rich gas expansion.

A very well-known process for the production of nitrogen is the single-column process with oxygen-rich or waste expansion. In this process, the dried and cleaned compressed air is cooled to near its dew point and fed to the bottom of a distillation column to obtain a fraction rich in nitrogen at the too and a liquid fraction rich in oxygen at the bottom. The bottom fraction is than expanded to lower pressure and is vaporised in the overhead condenser of the column against the condensing nitrogen-rich stream at the top of the column. Part of the nitrogen-rich stream can be recovered as nitrogen product. The condensed nitrogen-rich stream is returned to the top of the column as reflux liquid. The vaporized oxygen-rich stream is expanded isentropically in an expander to provide necessary refrigeration for the process. A major disadvantage of this process is the poor recovery rate of nitrogen. This is due to the fact that the recovery is limited by the equilibrium between the feed air and the oxygen-rich liquid at the bottom of the distillation column. Several techniques are known for improving the performance of this single-column process by adding a reboiler at the bottom of the distillation column. This reboiler will displace the phase equilibrium allowing higher product recovery rate. In order to provide the reboil for the bottom reboiler, an oxygen-rich stream can be recycled, compressed and condensed in the reboiler. However, this solution requires the recirculation and compression of an oxygen-rich stream and would be expensive since special material of construction and special precautions must be utilized to avoid the hazard associated with the handling of an oxygen-rich stream.

A reboiler using condensing air may be used as described, for example, in European patent application 183,446 and U.S. Pat. No. 4,617,037. This solution has a relatively narrow range of nitrogen pressure (about 3 to 3.5 bar absolute). Product compression is required for pressure above 3.5 bar, otherwise sharp reduction in process efficiency will occur.

A reboiler using a nitrogen cycle can be quite advantageous by contrast. For example, the recycle compressor and the product compressor can be combined as a single compressor to yield a more cost-effective plant. U.S. Pat. No. 4,665,918 describes an air separation process where two nitrogen reboilers are used in a single distillation column process. A bottom reboiler condenses high pressure recycled nitrogen to provide a first reboil fraction. An intermediate reboiler condenses lower pressure nitrogen to provide additional reboil. This process requires complex equipment and multistage recycle compression machinery. Another inconvenience of this process is the relatively low pressure of the feed air: for the process to be efficient, the waste stream pressure leaving the process must be kept low at slightly above atmospheric pressure. This translates into correspondingly low column pressure which in turn results in low feed air pressure. The water and carbon dioxide removal which is usually necessary in the front-end clean-up equipment becomes more costly and more energy intensive since more heat must be applied to regenerate the purification equipment. Furthermore, the arrangement of the expansion turbine discharging into an intermediate reboiler tends to limit the flexibility of this process when it comes to varying the cold production of the process: a change in expander flow would affect the column operation and product purity.

U.S. Pat. No. 4,400,188 discloses the use of a single-column process with bottom reboiler and oxygen-rich gas expansion. Nitrogen recycle is used to provide additional reboil and reflux. The major drawback of this process is the hazard associated with the expansion of oxygen-rich gas in the turbine machinery. Special materials and precautions must be utilized to minimize the risk. Furthermore, this process requires the distillation column to operate at relatively high pressure, which in turn translates into higher recycle flow rate for a given product recovery rate. This will result in higher power consumption.

Therefore, a need exists for a process which simultaneously enables a good nitrogen extraction yield, while keeping the apparatus cold by expansion of an oxygen-poor gas in a turbine.

These objects and others which will become more apparent in view of the following, are provided by a process for producing gaseous nitrogen from a mixture to be treated in a distillation column, said mixture comprising nitrogen and oxygen, said process comprising the steps of:

a) compressing the mixture to be treated to a pressure at least equal to the column pressure;

b) cooling the compressed gas mixture and subjecting at least a first portion of said cooled mixture to expansion through a turbine to produce the required refrigeration and thereafter fractionated distillation in the column to obtain, at the bottom of the column, an oxygen-enriched fraction and, at the top of the column, a nitrogen-enriched fraction;

c) drawing off at least a portion of the nitrogen-enriched fraction as nitrogen product;

d) compressing the remaining portion of the nitrogen-enriched fraction;

e) recycling at least a portion of the compressed remaining portion of the nitrogen-enriched fraction to the bottom reboiler of the column where it condenses to provide reboil for the column;

f) introducing at least a portion of the condensed nitrogen stream of step e) to the top of column as additional reflux; and g) drawing off an oxygen-enriched fraction in liquid form from the bottom of the column and expanding at least a portion of said fraction to a pressure less than the column pressure and vaporizing this portion by heat exchange with the condensing nitrogen-enriched fraction at the top of the column.

According to another embodiment, the invention also relates to a process for producing gaseous nitrogen from a mixture to be treated in a distillation column, said mixture comprising nitrogen and oxygen, said process comprising the steps of:

a) compressing the mixture to be treated to a pressure at least equal to the column pressure;

b) further compressing a first portion of said compressed gas mixture into a compressor driven by a turbine, cooling said further compressed gas mixture and expanding it through said turbine and thereafter fractionating by distillation said expanded gas mixture in the column to obtain, at the bottom of the column, an oxygen-enriched fraction and, at the top the column, a nitrogen-enriched fraction;

c) drawing off at least a portion of the nitrogen-enriched fraction as nitrogen product;

d) compressing the remaining portion of the nitrogen-enriched fraction;

e) recycling at least a portion of the compressed remaining portion of the nitrogen-enriched fraction to the bottom reboiler of the column where it condenses to provide reboil for the column;

f) introducing at least a portion of the condensed nitrogen stream of step e) to the top of column as additional reflux; and g) drawing off an oxygen-enriched fraction in liquid form from the bottom of the column and expanding at least a portion of said fraction to a pressure less than the column pressure and vaporizing this portion by heat exchange with the condensing nitrogen-enriched fraction at the top of the column.

According to other embodiments of the invention, the expansion turbine drives a compressor to additionally compress the first portion of the compressed gas mixture, before cooling it and expanding it in the turbine.

In another embodiment of the invention, an additional higher pressure column is provided with the distillation column to remove from compressed air the light products such as $H_2$, He and Ne from the nitrogen product to make very pure nitrogen product.

According to a further embodiment of the invention, compressed air is expanded in the turbine only for refrigeration of the column, the expanded air being e.g. vented with the waste stream from the column after heat exchange in the main heat exchanger. One might use either a single turbine, or a compressor driven by said turbine.

It is also possible in another embodiment, according to the process of the invention, to withdraw a portion of the nitrogen-rich recycling gas and expand it in a turbine to make refrigeration and recombine it with the nitrogen-rich stream and simultaneously use an air turbine to expand a portion of the feed cooled gas mixture (air) for refrigeration and for feeding the distillation column.

In all of the above embodiments, it is usually preferred to have the pressure of the compressed gas mixture (air) greater than the column pressure where distillation is made. In that case, The remaining portion, if any, of said cooled mixture of step b) is usually expanded through a valve and introduced into the column as an additional feed. This introduction is preferably done at an intermediate stage which is usually above the point of introduction of said first portion of said cooled mixture in the column. According to the invention, the nitrogen product is either withdrawn from the column as a gas or as a liquid. Both can be withdrawn when there is a need for both liquid and gaseous product.

Also, according to one further embodiment of the invention, the process comprises a liquid assist step (nitrogen, oxygen-rich or both) to provide e.g. more refrigeration during high demand period. The liquid (nitrogen or oxygen-rich) necessary for this liquid assist is stored from the column during periods of lower demand.

SUMMARY OF THE INVENTION

Accordingly, it is an object of the present invention to provide a process for the production of gaseous nitrogen with an excellent extraction yield.

It is also an object of the present invention to provide a process for the production of gaseous nitrogen such that the apparatus is kept cold by the expansion of an oxygen-poor gas in a turbine.

DETAILED DESCRIPTION OF THE PREFERRED EMBODIMENTS

According to the present invention, the necessary refrigeration for the present process is provided either by expanding a feed gas stream into the column or by expanding a feed gas stream into a low pressure stream, for example the waste stream.

According to one embodiment of the present invention, the expanded stream is a fraction of the feed gas. In another embodiment, a fraction of expanded stream is recombined with the oxygen-enriched stream before reheating. In this case, a condensed part of the cycle gas can be diverted toward a buffer capacity. This stored liquid will be re-injected into the column in the event of an increase in the nitrogen-production rate. Later, a fraction of the oxygen-rich liquid stored in another buffer capacity will be re-injected into the condenser at the top of the column, in the event of a reduced gaseous nitrogen production, allowing to restore the inventory of liquid nitrogen.

The present invention will now be described with reference to FIGS. 1 to 7, which represent various examples of methods of implementing the process according to the invention.

Figure 1:
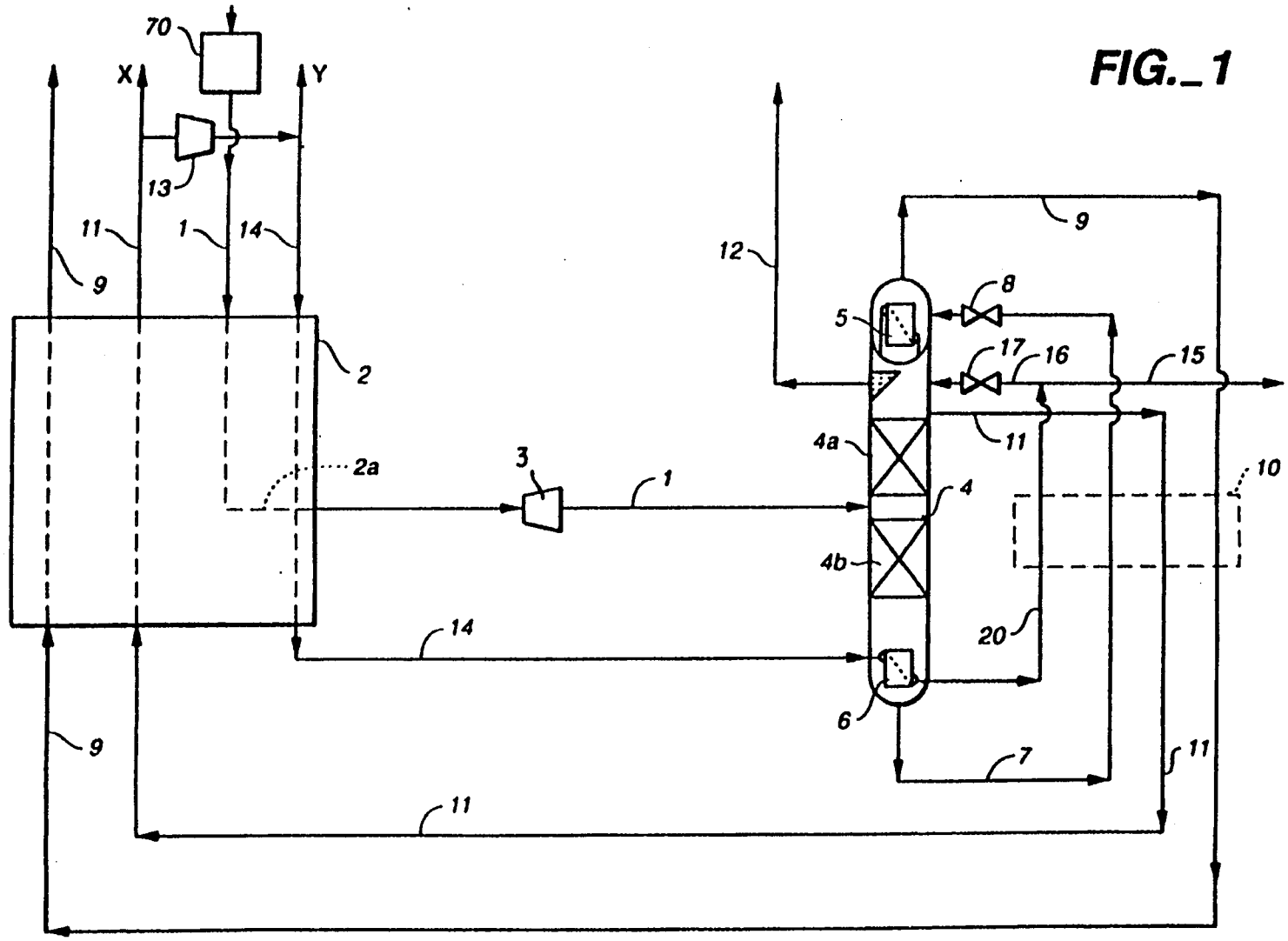
FIGS. 1–7 each illustrate a particular method and associated apparatus for implementing the present invention.

According to FIG. 1, a gaseous stream in conduit 1, e.g. air is purified (e.g. removal of $H_2O$ and $CO_2$) by conventional purification means (70), then compressed to a pressure greater than the pressure of the distillation column (4), defined below.

In heat exchanger (2), this stream is cooled to an intermediate temperature at the conduit (**2*a*). This gaseous stream is then expanded to a pressure of about 3 to 6 bars absolute in the turbine (3), and is then introduced into the distillation column (4), at an intermediate level between two distillation zones, one upper (4*a*) and the other lower (4*b***).

At the lower part of the column (4), an oxygen-enriched liquid fraction (7) is collected, which is extracted from the column, optionally sub-cooled in the exchanger (10), expanded in the valve (8) and finally introduced into the condenser of the column (4), comprised essentially of an exchanger (5) for the condensation of all or part of the gaseous fraction available at the top of the column (4). This oxygen-enriched fraction is extracted from the aforementioned condenser, in the conduit (9), then optionally reheated in exchanger (10), then exchanger (2), and finally is removed as an oxygen-rich stream.

As to the nitrogen-enriched stream available at the top of the column (4), a fraction is condensed in the exchanger (5) to provide reflux for the distillation. Another fraction may be extracted as a product in liquid form in the conduit (12), and one part is usually extracted, in gaseous form in the conduit (11), as a gaseous nitrogen-rich stream which is reheated, optionally, in exchanger (10), then in exchanger (2), to yield a relatively pure stream of gaseous nitrogen product.

A part of this gaseous nitrogen product is compressed in compressor (13). A fraction of this compressed nitrogen product may be used as a high-pressure product while the remaining fraction is recycled back to the cryogenic process via conduit (14). This stream (14) is first cooled in the exchanger (2), at least a fraction is condensed at the bottom of the column (4), in the exchanger (6), by heat exchanging with the vaporizing oxygen-rich fraction to provide reboil for the column. Then the stream (20) of condensed nitrogen is, optionally, sub-cooled in the exchanger (10), expanded in the valve (17), and introduced at the top of the column (4) as reflux. A fraction (15) can be recovered from the stream (20) to yield a fraction of liquid nitrogen product.

The embodiment described in FIG. 2 differs from the method described previously, as follows:

The stream of compressed air (1) is divided into two parts, the first part is (2*a*) treated as above, i.e. expanded in the turbine (3) and introduced into the column (4), and a second part is further cooled in the exchanger (2) until totally or partially liquefied in conduit (111), expanded in the valve (112) and introduced into the column (4) at an intermediate level, preferably above the point of introduction of the expanded gaseous stream. Therefore, the distillation column (4) can be divided into three zones, respectively from top to bottom (4*a*), (4*b*) and (4*c*).

The embodiment of FIG. 3 differs from the method of execution shown in FIG. 2 as follows:

A portion (1*b*) of the compressed air (1) is further compressed in the compressor (50) driven by the expansion turbine (3), and cooled to ambient temperature in the exchanger (51). This fraction is then cooled into the exchanger (2) and extracted at an intermediate temperature, expanded in the turbine (3) and introduced into the column (4).

The other part (111) of The compressed air undergoes, as above, further cooling in the exchanger (2), where it may be partially or totally condensed in conduit (111) before being expanded through valve (112) and injected into the column (4), e.g. above the injection point of conduit 1.

Figure 2:
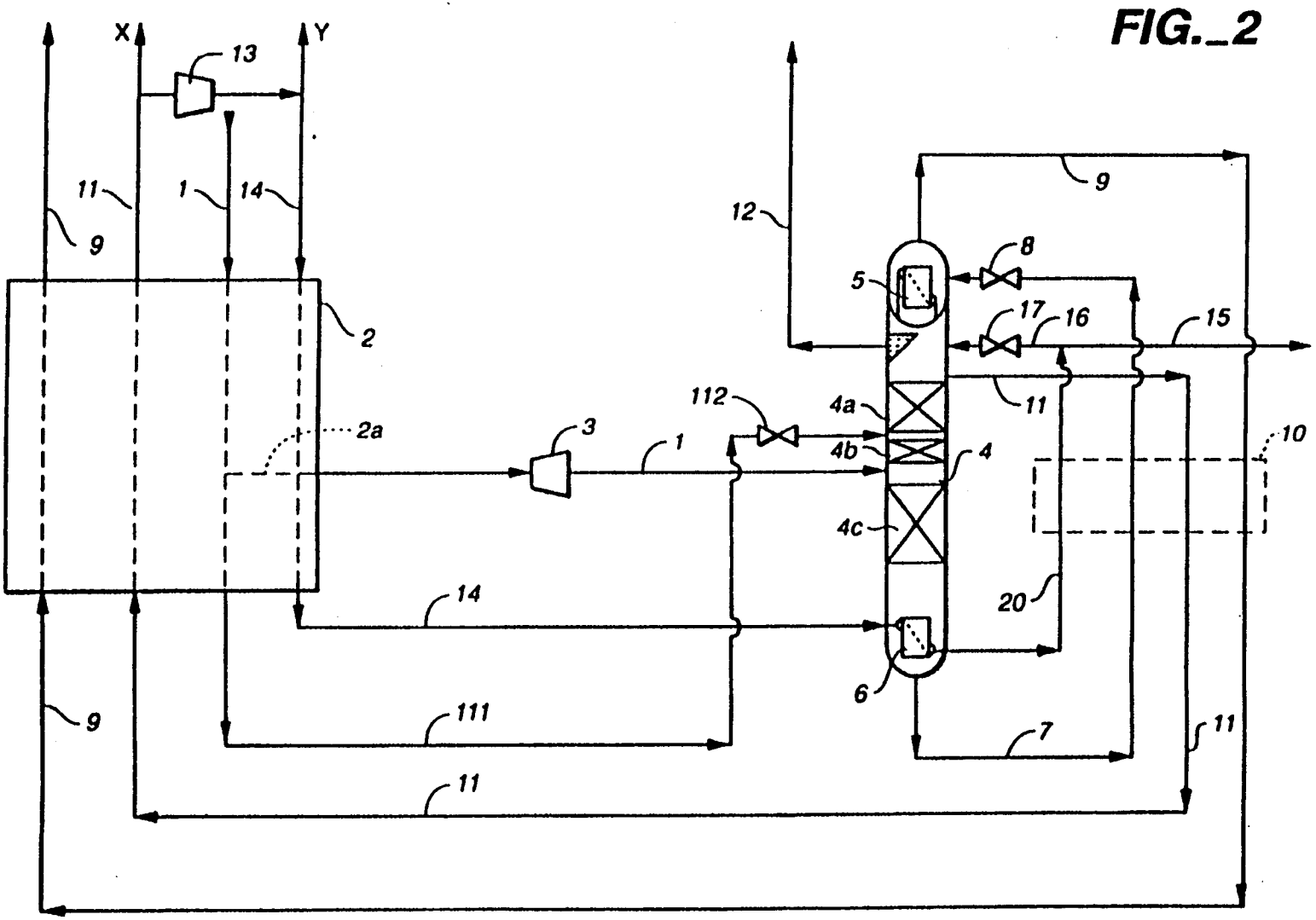
Figure 3:
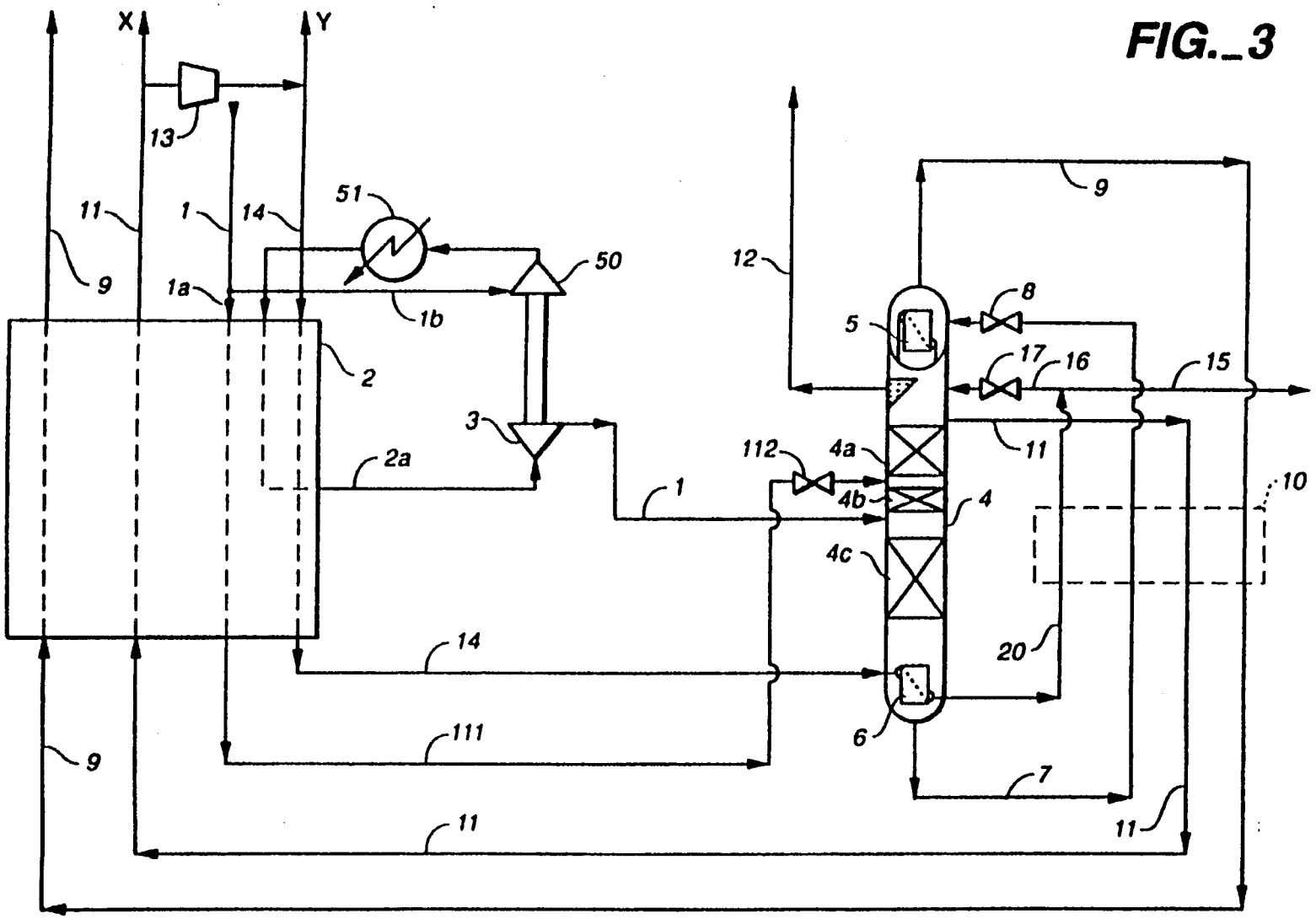
Figure 4:
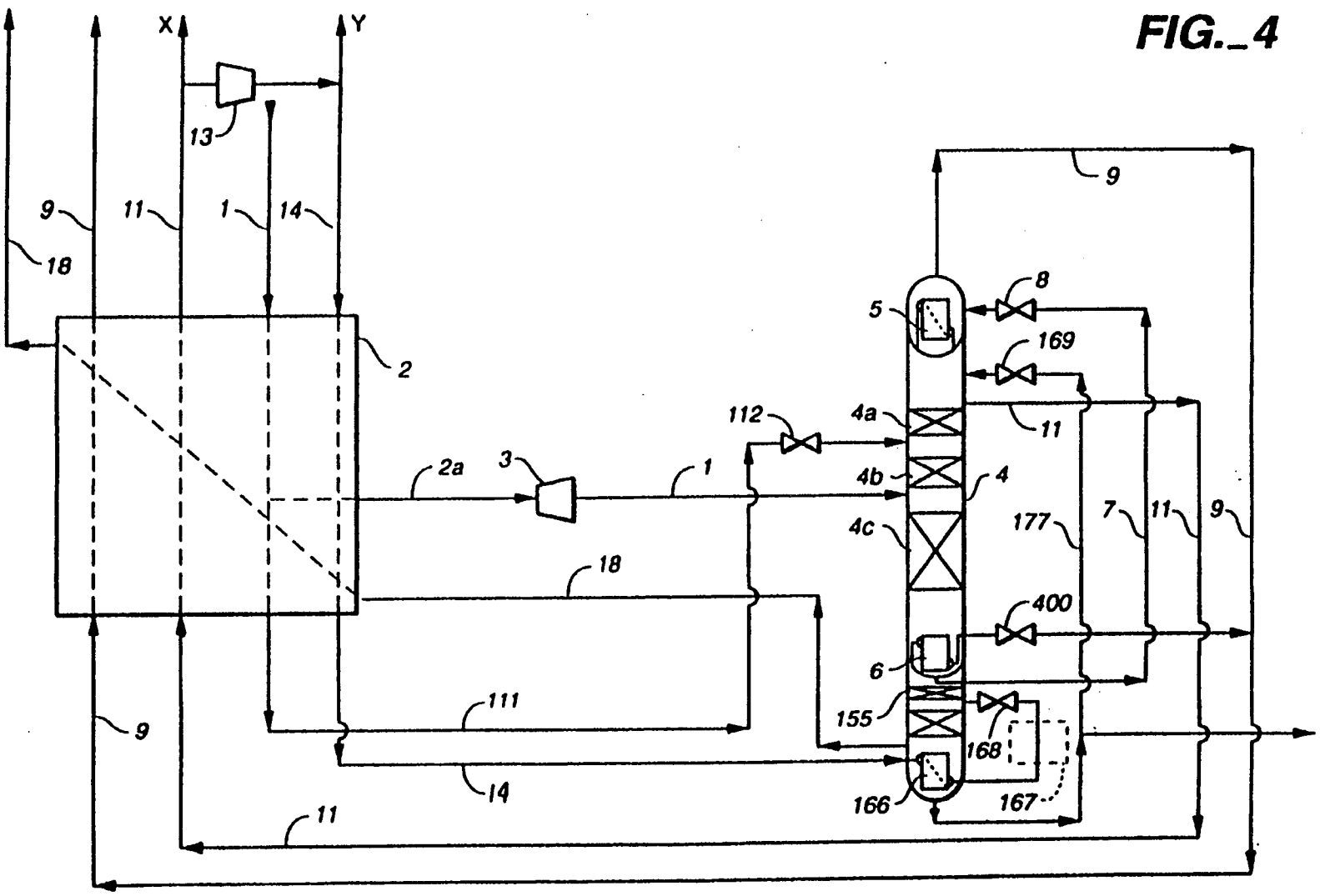

The embodiment of FIG. 4 differs from the embodiment shown in FIG. 2 as follows:

The fractionated distillation is done in two columns (4 and 155), a first column (4) at a relatively low temperature, equivalent to the distillation column (4) of FIG. 2, and a second column (155) at a relatively high temperature, operating under relatively high pressure, at about 6 to 12 bars (operating at a pressure usually higher than that in column 4).

The stream of recycled nitrogen (14) is introduced into the reboiler (166) located at the bottom of second column (155) instead of being introduced as previously into the bottom reboiler of the first column (4). At least a fraction of this stream (14) is condensed at the bottom of the column (155), in the reboiler (166), by heat exchange with the vaporizing nitrogen-rich fraction at the bottom of the same column (155). Then the condensed stream may pass through an impurity-removal filter (such as CO) of the cold absorption type (167) (shown with dotted lines), expanded through a valve (168) and introduced into the column (155) at an intermediate stage. The relatively light fraction recovered at the top of this column (155) is almost totally condensed in the exchanger (6) located at the bottom of the column (4), in heat exchange with the vaporized oxygen-rich fraction at the bottom of the column (4). The non-condensible fraction recovered at the outlet of the exchanger (6) is expanded through a valve (400) into the residual gas (9).

The relatively heavy fraction at the bottom of the column (155) is removed by the conduit (18), in gaseous form, reheated in the exchanger (2), and recovered as nitrogen gas without light impurities. A relatively heavy fraction available in liquid form at the bottom of the second column (155) is drawn off in stream (177) which is expanded in the valve (169) and introduced at the top of the first distillation column (4) as reflux.

Moreover, the stream of compressed air (1) is divided into two parts; the first part (2*a*) is treated as previously, i.e. expanded in the turbine (3) and introduced into the column (4), and a second part is further cooled in the exchanger (2) until liquefaction (at least partly) in conduit (111), expanded in the valve (112) and introduced into the column (4), above the feed point of the expanded gaseous stream (1). Therefore, the distillation column (4) can be divided into 3 zones, respectively from top to bottom (4*a*), (4*b*) and (4*c*).

Figure 5:
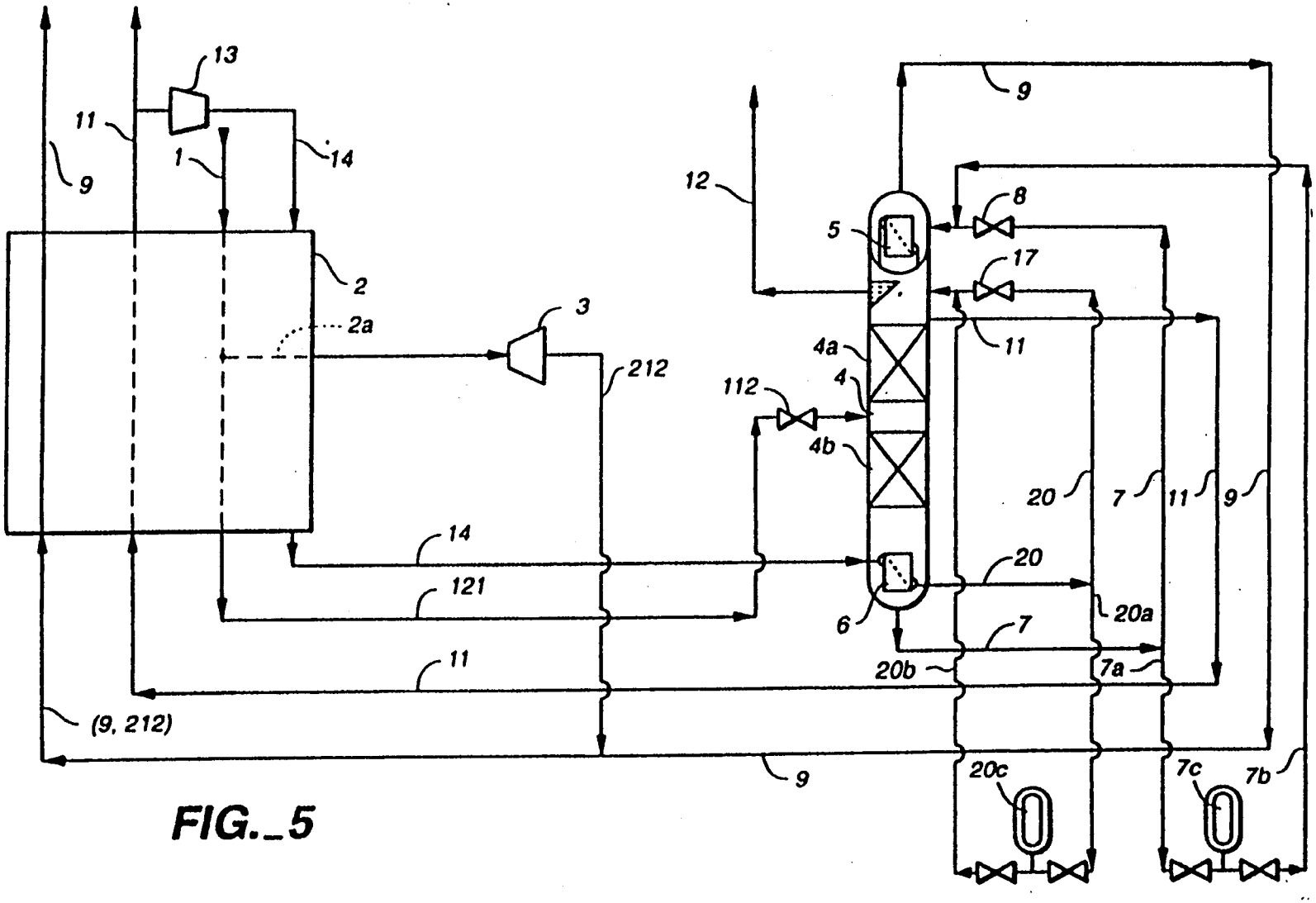

The embodiment of FIG. 5 is similar to that of FIG. 2 except the following main differences:

First, as in FIG. 2, a stream of cooled compressed air (1) is divided into two parts, a first part (2*a*) is suspected to expansion in the turbine (3) and the remaining part (121) is further cooled and then introduced into the column (4). However, the stream of expanded air (212) is not sent into the distillation column (4), but is combined instead with the oxygen-rich fraction (9) and is then rewarmed. The conduit (9-212) after being reheated in the exchanger (2) leaves the process.

In the embodiment of FIG. 5, the liquid products can be stored during periods of relatively low demand of the user and be vaporized during periods of high demand.

To this end, a stream of recycled nitrogen condensed in the reboiler (6) can be extracted from conduit (20) by a conduit (20*a*) toward a buffer-capacity (20*c*). Later on, during a nigh demand period of the user, this liquefied nitrogen can be sent back by the conduit (20*b*) to the column (4), downstream of the valve (17). Similarly, the oxygen-rich fraction (7) from the bottom of column (4) can be extracted by conduit (7*a*) toward the buffer-capacity (7*a*) and later on be sent back by the conduit (7*b*) to the column (4), downstream of the valve (8) (a process known as "liquid assist" process).

Figure 6:
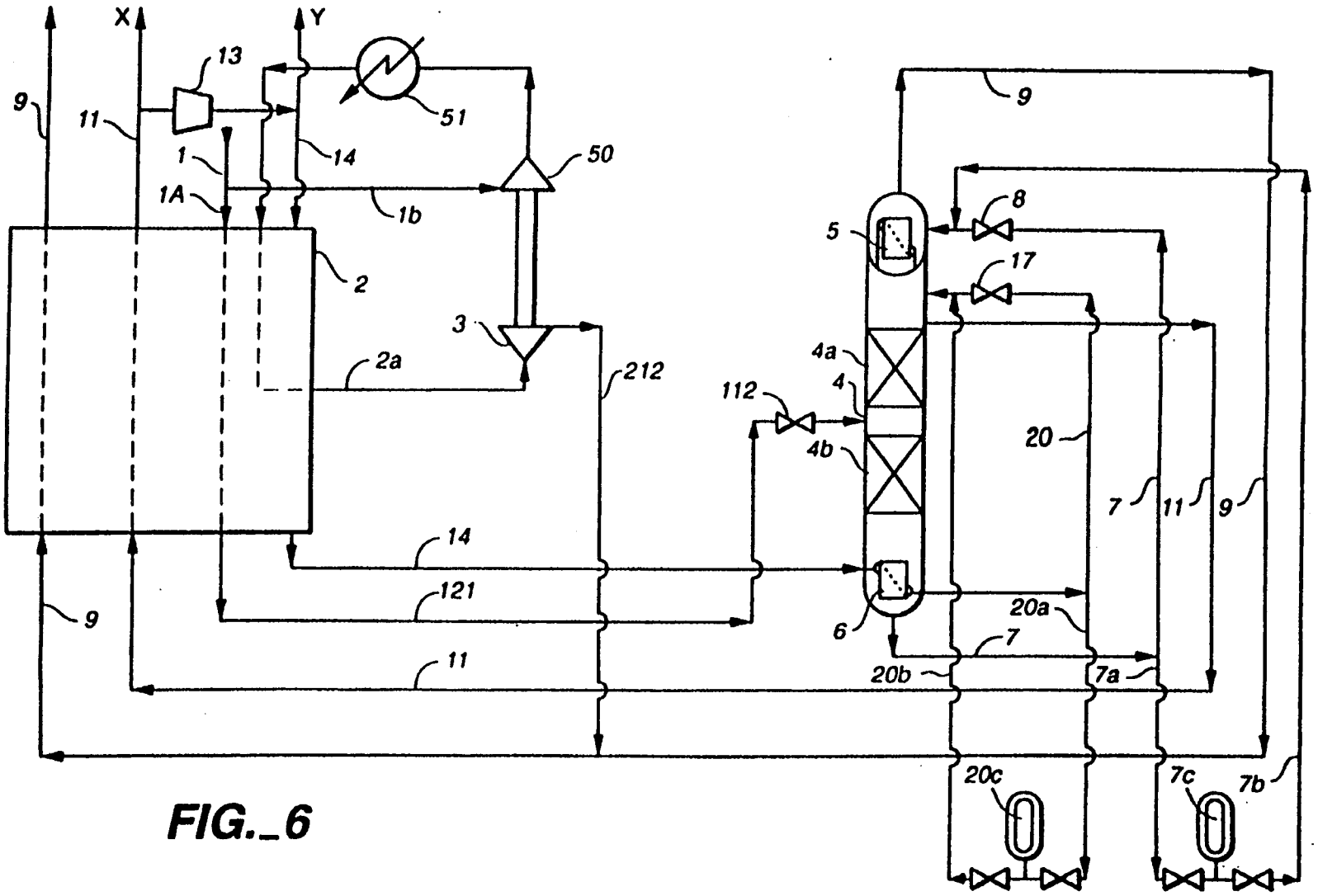

The embodiment of FIG. 6 is similar to that of FIG. 5, except for the following main differences:

A first part (1*a*) of the compressed air (1) is cooled in the exchanger (2), then introduced through the conduit (121) and the valve 112 into the column (4), while the other part (1*b*) of the compressed air (1) is further compressed in compressor (50) driven by the turbine (3), cooled to ambient temperature in the exchanger (51) and then introduced and cooled into the exchanger (2). It is then extracted at an intermediate temperature, expanded in the turbine (3) via conduit (212), and recombined with the oxygen-rich fraction (9) vaporized in the condenser (5).

The two buffered processes described in FIGS. 5 and 6 present the advantage of providing a variable gaseous nitrogen production ranging from about 50% to about 150% of the nominal production, providing, among others, additional refrigeration when more nitrogen product is needed.

Figure 7:
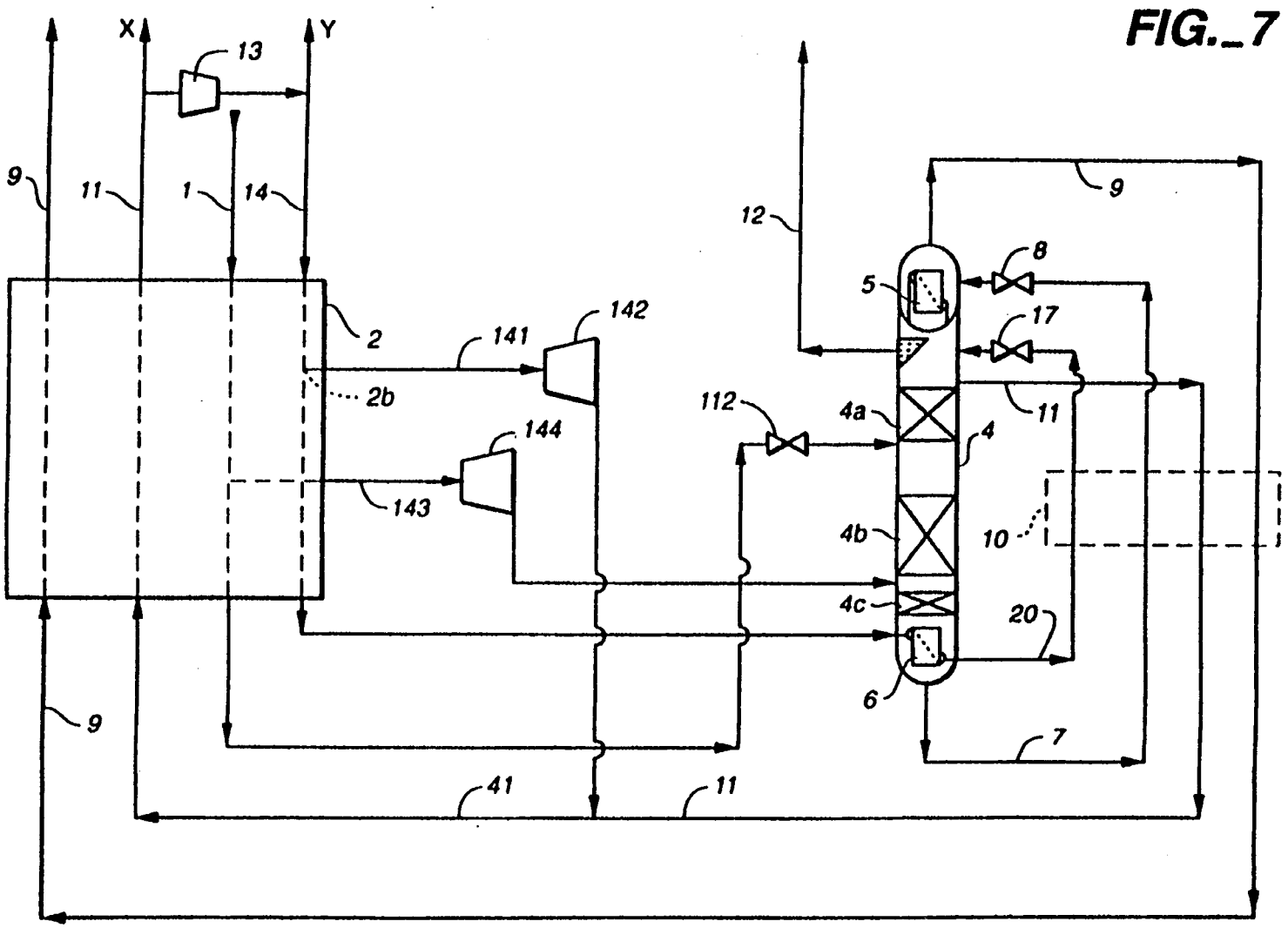

The embodiment described on FIG. 7 is similar to that described on FIG. 2, except the following main differences:

A fraction (141) of the nitrogen-rich recycling gas (14) drawn off at an intermediate temperature (2*b*) from the exchanger (2), is expanded to a low pressure in the turbine (142), then, without passing into the column (4), is recombined with the nitrogen-rich stream (11), and then is reheated in the exchanger (2).

In this embodiment, she air turbine (144) is used for the production of gaseous nitrogen without the production of liquid. When the need for producing liquid arises, a fraction of the recycled nitrogen (14) is expanded in the turbine (142) to provide additional cooling. With this arrangement, it is possible to have a gas/-liquid flexibility of the nitrogen production.

What is claimed is:

1. A process for producing gaseous nitrogen from a mixture to be treated in a distillation column, said mixture comprising nitrogen and oxygen, said process comprising the steps of:

a) compressing the mixture to be treated to a pressure at least equal to the column pressure;

b) cooling the compressed gas mixture and expanding a first portion of said cooled mixture in a turbine to produce an expanded feed gas mixture for refrigeration and fractionated distillation in the column to obtain, at a lower portion of the column, an oxygen-enriched fraction and, at the top of the column, a nitrogen-enriched fraction;

c) drawing off at least a portion of the nitrogen-enriched fraction as nitrogen product;

d) compressing the remaining portion of the nitrogen-enriched product;

e) recycling at least a portion of the compressed remaining portion of the nitrogen-enriched fraction to a lowest-positioned reboiler of the column where it condenses to provide reboil for the column;

f) introducing at least a portion of the condensed nitrogen stream of step e) to the column as reflux; and g) drawing off an oxygen-enriched fraction in liquid form from the bottom of the column and expanding at least a portion of said fraction to a pressure less than the column pressure and vaporizing this portion by heat exchange with nitrogen-enriched fraction condensing at the top of the column.

2. The process according to claim 1, wherein the nitrogen product withdrawn from the column is either a gas or a liquid.

3. The process according to claim 1, wherein both liquid and gaseous nitrogen are withdrawn from the column as a product.

4. The process according to claim 1, wherein the remaining portion of said cooled mixture of step b) is expanded through a valve and introduced into the column as an additional feed.

5. The process according to claim 4, wherein said remaining portion is further cooled before being expanded through said valve.

6. The process according to claim 1, wherein the pressure of the mixture of step a) is greater than the pressure of the column.

7. The process according to claim 1, wherein said turbine drives compressing means to further compress the first portion of the compressed gas mixture before cooling it and expanding it in the turbine.

8. The process according to claim 1, wherein said distillation column comprises a low pressure distillation column and a high pressure distillation column, wherein said low pressure column is fluidly connected to said high pressure column, whereby light components are removed.

9. The process according to claim 1, which further comprises withdrawing a portion of the nitrogen-rich recycling gas and expanding it in a second turbine to provide refrigeration, and combining it with the nitrogen-rich stream and simultaneously using said first turbine to expand a portion of said cooled gas mixture to produce refrigeration and for feeding the distillation column.

10. The process according to claim 1, wherein said compressed gas mixture is compressed to a pressure which is greater than the distillation column pressure, and wherein any remaining portion of cooled mixture of step b) is expanded through a valve and introduced into the column as additional feed.

11. The process according to claim 1, which further comprises, prior to step a), purifying the mixture to be compressed and treated by removing $H_2O$ and $CO_2$.

12. The process according to claim 1, wherein said turbine drives compressing means to further compress the first portion of the compressed gas mixture before cooling it and expanding it in the turbine.

13. The process according to claim 1, wherein said distillation column is fluidly connected to a high pressure column, whereby light products are removed from compressed air.

14. The process according to claim 1, wherein in step b) said expanded feed gas mixture from said turbine is fed directly into said column at substantially turbine outlet condition at an intermediate level between two distillation zones.

15. A process for producing gaseous nitrogen from a mixture to be treated in a distillation column, said mixture comprising nitrogen and oxygen, said process comprising the steps of:

a) compressing the mixture to be treated to a pressure at least equal to the column pressure;

b) further compressing a first portion of said compressed gas mixture into a compressor driven by a turbine, cooling said further compressed gas mixture and expanding it in said turbine and thereafter fractionating by distillation said expanded gas mixture in the column to obtain, at a lower portion of the column, an oxygen-enriched fraction and, at the top of the column, a nitrogen-enriched fraction;

c) drawing off at least a portion of the nitrogen-enriched fraction as nitrogen product;

d) compressing the remaining portion of the nitrogen-enriched fraction;

e) recycling at least a portion of the compressed remaining portion of the nitrogen-enriched fraction to a lowest-positioned reboiler of the column where it condenses to provide reboil for the column;

f) introducing at least a portion of the condensed nitrogen stream of step e) to the column as reflux; and g) drawing off an oxygen-enriched fraction in liquid form from the bottom of the column and expanding at least a portion of said fraction to a pressure less than the column pressure and vaporizing this portion by heat exchange with nitrogen-enriched fraction condensing at the top of the column.

16. The process according to claim 15, wherein the nitrogen product withdrawn from the column is either a gas or a liquid.

17. The process according to claim 15, wherein both liquid and gaseous nitrogen are withdrawn from the column as a product.

18. The process according to claim 15, wherein the remaining portion of said compressed gas mixture of step b) is cooled and then expanded through a valve and introduced into the column as an additional feed.

19. The process according to claim 15, which further comprises withdrawing a portion of the nitrogen-rich recycling gas and expanding it in a turbine to provide refrigeration, and recombining it with the nitrogen-rich stream and simultaneously using said turbine to expand a portion of the feed cooled gas mixture for refrigeration and for feeding the distillation column.

20. The process according to claim 15, wherein said compressed gas mixture is compressed to a pressure which is greater than the distillation column pressure, and wherein any remaining portion of cooled mixture of step b) is expanded through a valve and introduced into the column as additional feed.

21. The process according to claim 15, which further comprises, prior to step a), purifying the mixture to be compressed and treated by removing $H_2O$ and $CO_2$.

22. The process according to claim 15, wherein in step b) said expanded feed gas mixture from said turbine is fed directly into said column at substantially turbine outlet condition at an intermediate level between two distillation zones.

23. A process for producing gaseous nitrogen from a mixture to be treated in a distillation system comprising a low pressure distillation column and a high pressure distillation column, said mixture comprising nitrogen, oxygen and light impurities, said process comprising the steps of:

a) compressing the mixture to be treated to a pressure at least equal to the low pressure column pressure, b) cooling the compressed gas mixture and expanding a first portion of said cooled mixture in a turbine to produce an expanded gas mixture for refrigeration and fractionated distillation in the low pressure distillation column to obtain, at the bottom of the low pressure distillation column, an oxygen-enriched fraction and, at the top of the low pressure distillation column, a nitrogen-enriched fraction;

c) compressing at least a portion of the nitrogen-enriched fraction;

d) recycling at least a portion of the compressed portion of the nitrogen-enriched fraction to a lowest positioned reboiler of the high pressure distillation column where it at least partially condenses to provide reboil for the distillation system;

e) introducing at least a portion of the at least partially condensed nitrogen stream of step e) into the high pressure distillation column at an intermediate stage;

f) recovering a nitrogen product substantially free of light impurities from the high pressure distillation column, and;

g) drawing off an oxygen-enriched fraction from the bottom of the low pressure distillation column and expanding at least a portion of said oxygen-enriched fraction to a pressure less than the low pressure column pressure and condensing at least a portion of the nitrogen-enriched fraction near the top of the low pressure column by heat exchange with the expanded oxygen-enriched fraction.

* * * * *